US008752639B2

(12) United States Patent
Long

(10) Patent No.: US 8,752,639 B2
(45) Date of Patent: Jun. 17, 2014

(54) FIRE SUPPRESSION SYSTEM AND METHOD THEREOF

(75) Inventor: Robert A. Long, Clarkston, MI (US)

(73) Assignee: Arlo Investments, LLC, Clarkston, MI (US)

( * ) Notice: Subject to any disclaimer, the term of this patent is extended or adjusted under 35 U.S.C. 154(b) by 483 days.

(21) Appl. No.: 12/518,933

(22) PCT Filed: Dec. 14, 2007

(86) PCT No.: PCT/US2007/087516

§ 371 (c)(1), (2), (4) Date: Jun. 12, 2009

(87) PCT Pub. No.: WO2008/076858

PCT Pub. Date: Jun. 26, 2008

(65) Prior Publication Data

US 2010/0089598 A1 Apr. 15, 2010

Related U.S. Application Data

(60) Provisional application No. 60/875,049, filed on Dec. 15, 2006.

(51) Int. Cl.

| | |
|---|---|
| ***A62C 35/00*** | (2006.01) |
| ***A62C 37/36*** | (2006.01) |
| ***A62C 37/08*** | (2006.01) |

(52) U.S. Cl.

USPC ..... 169/17; 169/22; 169/35; 251/63.5

(58) Field of Classification Search

USPC ..... 169/15, 16, 17, 22, 37, 55, 9; 251/62–63.5

See application file for complete search history.

(56) References Cited

U.S. PATENT DOCUMENTS

| | | | |
|---|---|---|---|
| 440,100 | A | 11/1890 | Clapp |
| 914,883 | A | 3/1909 | Rockwood |
| 1,464,244 | A | 8/1923 | Drake |
| 1,464,926 | A | 8/1923 | Eastwood |
| 1,505,958 | A | 8/1924 | Huntting |

(Continued)

FOREIGN PATENT DOCUMENTS

| | | |
|---|---|---|
| JP | 55063066 | 5/1980 |
| JP | 2002065885 | 3/2002 |
| JP | 2003275335 | 9/2003 |

OTHER PUBLICATIONS

Patent Cooperation Treaty, International Search Report for International Application No. PCT/US2007/087516, May 7, 2008 (3 pages).

(Continued)

*Primary Examiner* — Justin Jonaitis

(57) ABSTRACT

A fire suppression system and method thereof is provided. The fire suppression system includes at least one inlet pipe, at least one outlet pipe, and a valve. The inlet pipe is at least partially filled with a fluid substance, wherein the fluid substance creates a first pressure in the inlet pipe. The outlet pipe is in fluid communication with the inlet pipe and contains a gaseous fluid, wherein the gaseous fluid creates a second pressure in the outlet pipe. The valve is in fluid communication between the inlet pipe and the outlet pipe, wherein the fluid substance enters the outlet pipe through the valve when the second pressure is altered to a predetermined pressure.

22 Claims, 6 Drawing Sheets

(56) References Cited

U.S. PATENT DOCUMENTS

| | | | | | |
|---|---|---|---|---|---|
| 1,600,468 | A | | 9/1926 | Hennebohle | |
| 1,662,839 | A | | 3/1928 | Tyden | |
| 1,790,467 | A | | 1/1931 | Griffith | |
| 1,815,355 | A | * | 7/1931 | Hamilton | 169/21 |
| 1,856,333 | A | | 5/1932 | Hodgman, Jr. | |
| 1,900,632 | A | | 3/1933 | Boardman | |
| 1,911,107 | A | | 5/1933 | Carter | |
| 1,913,027 | A | | 6/1933 | Griffith | |
| 1,932,324 | A | | 10/1933 | Rowley | |
| 1,933,214 | A | | 10/1933 | Halford | |
| 1,941,694 | A | | 1/1934 | Kilgour | |
| 1,941,695 | A | | 1/1934 | Kilgour | |
| 1,947,309 | A | | 2/1934 | Rowley | |
| 1,976,022 | A | | 10/1934 | Hutchinson | |
| 2,003,884 | A | | 6/1935 | Halford | |
| 2,099,069 | A | | 11/1937 | Lowe et al. | |
| 2,266,421 | A | | 12/1941 | Griffith | |
| 2,290,358 | A | | 7/1942 | Rider | |
| 2,357,133 | A | | 8/1944 | Rider | |
| 2,384,342 | A | | 9/1945 | Rider | |
| 2,389,817 | A | | 11/1945 | Rider | |
| 2,398,461 | A | | 4/1946 | Rider | |
| 2,400,372 | A | | 5/1946 | Rider | |
| 2,447,174 | A | | 8/1948 | Griffith | |
| 2,469,831 | A | | 5/1949 | Lewis | |
| 2,475,489 | A | | 7/1949 | Gathercoal | |
| 2,505,761 | A | * | 5/1950 | Gieseler | 169/16 |
| 2,506,468 | A | | 5/1950 | Rider | |
| 2,597,474 | A | | 5/1952 | Griffith | |
| 2,713,916 | A | | 7/1955 | Muckenfuss | |
| 2,717,001 | A | | 9/1955 | Perrault | |
| 2,891,625 | A | * | 6/1959 | Hube | 169/16 |
| 3,075,547 | A | | 1/1963 | Scaramucci | |
| 3,307,633 | A | | 3/1967 | Newall | |
| 3,315,748 | A | | 4/1967 | Merdinyan et al. | |
| 3,331,391 | A | | 7/1967 | Merdinyan | |
| 3,447,609 | A | | 6/1969 | Harvey | |
| 3,595,318 | A | | 7/1971 | Merdinyan | |
| 3,616,860 | A | * | 11/1971 | Willms | 169/17 |
| 3,727,878 | A | * | 4/1973 | Willms | 251/57 |
| 3,883,111 | A | | 5/1975 | Jourdan | |
| 4,367,861 | A | | 1/1983 | Bray et al. | |
| 4,552,221 | A | | 11/1985 | Klein | |
| 4,596,514 | A | * | 6/1986 | Matsumoto et al. | 417/44.3 |
| 4,647,003 | A | * | 3/1987 | Hilpert et al. | 251/14 |
| 4,854,342 | A | | 8/1989 | Polan | |
| 5,143,112 | A | | 9/1992 | Scaramucci | |
| 5,295,503 | A | | 3/1994 | Meyer et al. | |
| 5,439,028 | A | | 8/1995 | Meyer et al. | |
| 5,971,080 | A | | 10/1999 | Loh et al. | |
| 5,992,532 | A | | 11/1999 | Ramsey et al. | |
| 6,000,473 | A | | 12/1999 | Reilly | |
| 6,029,749 | A | | 2/2000 | Reilly et al. | |
| 6,068,057 | A | | 5/2000 | Beukema | |
| 6,155,531 | A | * | 12/2000 | Holborow et al. | 251/30.02 |
| 6,158,520 | A | * | 12/2000 | Reilly et al. | 169/17 |
| 6,293,348 | B1 | | 9/2001 | Reilly | |
| 6,578,602 | B1 | | 6/2003 | Kirschner | |
| 6,651,687 | B2 | * | 11/2003 | Taylor | 137/70 |
| 6,666,277 | B2 | | 12/2003 | Reilly | |
| 6,752,217 | B2 | * | 6/2004 | Reilly | 169/17 |
| 6,810,963 | B2 | | 11/2004 | Ringer | |
| 6,857,478 | B1 | | 2/2005 | Weber | |
| 6,926,023 | B2 | | 8/2005 | Cabral et al. | |
| 7,104,333 | B2 | | 9/2006 | Ringer | |
| 7,134,507 | B2 | | 11/2006 | Heskestad | |
| 7,337,856 | B2 | | 3/2008 | Lund et al. | |
| 7,673,695 | B2 | | 3/2010 | Deurloo | |
| 2002/0003042 | A1 | * | 1/2002 | Reilly | 169/17 |
| 2005/0155777 | A1 | | 7/2005 | Reilly et al. | |
| 2006/0021763 | A1 | | 2/2006 | Golinveaux | |
| 2006/0081292 | A1 | | 4/2006 | Sarno et al. | |
| 2006/0096763 | A1 | | 5/2006 | Ringer | |
| 2008/0105440 | A1 | * | 5/2008 | Jackson et al. | 169/20 |
| 2009/0288846 | A1 | | 11/2009 | Leblanc | |
| 2011/0253395 | A1 | * | 10/2011 | Long | 169/17 |

OTHER PUBLICATIONS

David L. Asplund, "Faster Water Transit Times for Large Dry Pipe Fire Sprinkler Systems," Feb. 26, 2002, FPM Engineer (2009). Retrieved Dec. 16, 2009, from http://www.pmengineer.com/Articles/Feature_Article/cc4b568d84298010VgnVCM100000f932a8c0.

"Dry Pipe Fire Suppression Sprinklers," DTW Works Master Specification, Section 13935, pp. 1-6, Issued Jun. 1, 2005, found at: http://www.tw.gov.nl.ca/works/masterspec/v2005/13935.pdf.

* cited by examiner

FIRE SUPPRESSION SYSTEM AND METHOD THEREOF

CROSS-REFERENCE TO RELATED APPLICATION

This application claims the benefit under 35 U.S.C. §119 (e) of U.S. Provisional Patent Application No. 60/875,049, entitled "FIRE SUPPRESSION SYSTEM," filed on Dec. 15, 2006, the entire disclosure of which is hereby incorporated herein by reference.

FIELD OF THE INVENTION

The present invention relates to a fire suppression system, and more particularly, to a dry pipe fire suppression system.

BACKGROUND OF THE INVENTION

Due to modern building codes, buildings above a predetermined size, based upon square footage, are generally required to have fire suppression systems. Generally, it may be beneficial to have a fire suppression system in any dwelling without regard to the size of the dwelling. However, due to climates where freezing temperatures are reached, fire suppression systems can generally be designed so that the water being held in portions of the system does not freeze. Typically, if the water in the fire suppression system does freeze, the fire suppression system can be rendered inoperable and/or cause damage to the fire suppression system. More specifically, the piping in the system can be damaged. Generally, environments having excessive temperatures that cause the water in the pipes to boil or climates with extreme temperature fluctuations can have adverse effects on pipes and/or piping components of the fire suppression system due to thermal expansion and contortion.

One exemplary system designed to prevent a fluid within the system from freezing is a system wherein the pipes of the fire suppression system are filled with glycol. Generally, glycol has a low freezing temperature when compared to the freezing temperature of water, which allows it to withstand cold ambient temperatures without freezing. However, the glycol systems typically require constant maintenance, which can be an expensive process. Additionally, glycol systems are generally undesirable, especially for residential dwellings, due to the chemical agent being constantly present in the fire suppression system piping that extends throughout the dwelling.

When a fire suppression system uses glycol or a similar chemical agent, the system typically includes a check valve that separates the glycol and the water. The check valve generally only allows fluids to flow one way, such that the glycol is prevented from entering the area of the system occupied by water. Thus, once the glycol is removed from the system, the check valve typically allows the water to flow into the area of the system where the glycol was previously present. Generally, the glycol exits the system when a sprinkler head is opened, and the glycol is discharged over an area surrounding the sprinkler head prior to the sprinkler head discharging water over the surrounding area. Further, the fire suppression system using a check valve generally requires a second fluid, such as the glycol, to be in a portion of the system, otherwise water would pass through the check valve at undesirable times, which creates a potential for the water to freeze and damage the system.

Additionally, in any fire suppression system where there is a fluid material in the system, there is generally a possibility of the fluid exiting the system at undesirable times. For example, the fluid material can leak from the fire suppression system and cause damage to item or objects around the system, such as furniture in a residential dwelling or inventory in a commercial or industrial dwelling.

SUMMARY OF THE INVENTION

According to one aspect of the present invention, a fire suppression system includes at least one inlet pipe, at least one outlet pipe, and a valve assembly. The at least one inlet pipe is at least partially filled with a fluid substance, wherein the fluid substance creates a first pressure in the at least one inlet pipe. The at least one outlet pipe is in fluid communication with the at least one inlet pipe and contains a gaseous fluid, wherein the gaseous fluid creates a second pressure in the at least one outlet pipe. The valve assembly is in fluid communication between the at least one inlet pipe and the at least one outlet pipe, wherein the fluid substance enters the at least one outlet pipe through the valve when the second pressure is altered to a predetermined pressure.

According to another aspect of the present invention, a fire suppression system includes at least one inlet pipe, at least one outlet pipe, and a valve assembly. The at least one inlet pipe is at least partially filled with a fluid substance, wherein the fluid substance creates a first pressure in the at least one inlet pipe. The at least one outlet pipe is in fluid communication with the at least one inlet pipe and contains a gaseous fluid, wherein the gaseous fluid creates a second pressure in the at least one outlet pipe, and the at least one outlet pipe defines at least one opening. The valve assembly is a direct-acting actuated dry valve assembly that is in fluid communication between the at least one inlet pipe and the at least one outlet pipe, wherein the fluid substance enters the at least one outlet pipe through the direct-acting dry valve assembly when the second pressure is altered to a predetermined pressure, and the fluid substance exits the at least one outlet pipe through the at least one opening.

According to yet another aspect of the present invention, a method of suppressing a fire includes the steps of pressurizing an inlet pipe at a first pressure with a fluid substance, and pressurizing an outlet pipe at a second pressure with a gaseous substance. The method further includes the steps of altering the outlet pipe pressure, and opening a valve assembly that is in fluid communication between the inlet and outlet pipes when the outlet pipe pressure is altered, such that the gaseous fluid one of enters and exits the outlet pipe to alter the second pressure, and the fluid substance enters and exits the said outlet pipe.

These and other features, advantages, and objects of the present invention will be further understood and appreciated by those skilled in the art by reference to the following specification, claims, and appended drawings.

BRIEF DESCRIPTION OF THE DRAWINGS

The present invention will become more fully understood from the detailed description and the accompanying drawings, wherein.

DETAILED DESCRIPTION OF PREFERRED EMBODIMENTS

Figure 1:
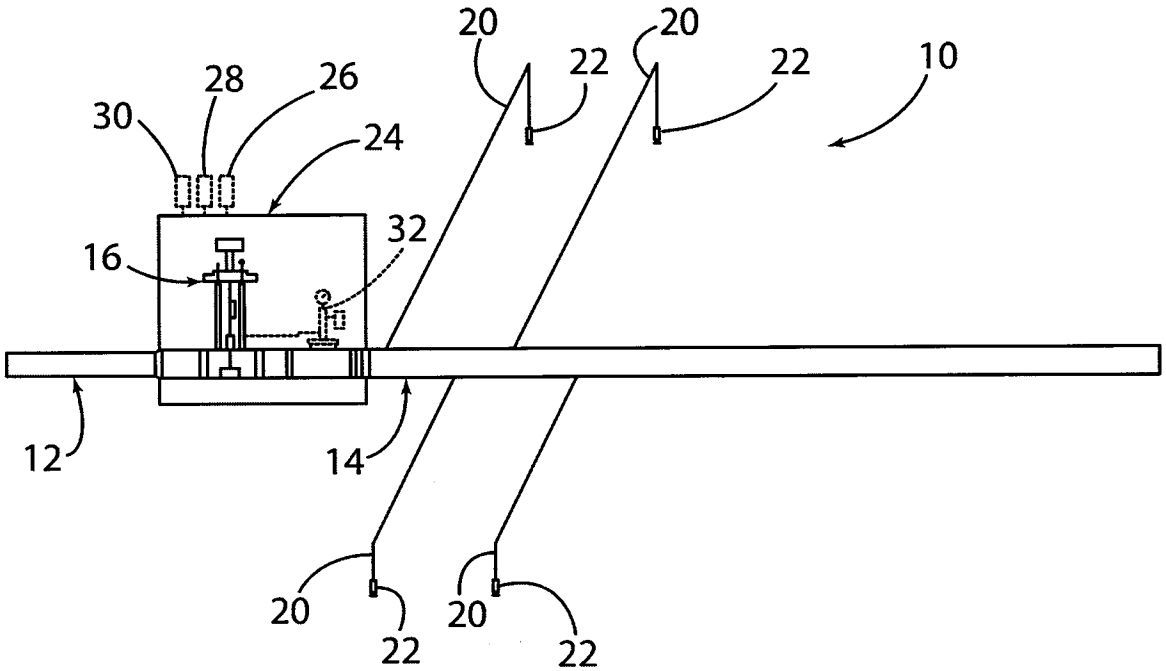
FIG. 1 is a schematic plan view of a fire suppression system, in accordance with one embodiment of the present invention.

The present illustrated embodiments reside primarily in combinations of method steps and apparatus components related to a fire suppression system and method thereof. Accordingly, the apparatus components and method steps have been represented, where appropriate, by conventional symbols in the drawings, showing only those specific details that are pertinent to understanding the embodiments of the present invention so as not to obscure the disclosure with details that will be readily apparent to those of ordinary skill in the art having the benefit of the description herein. Further, like numerals in the description and drawings represent like elements.

In this document, relational terms, such as first and second, top and bottom, and the like, are used solely to distinguish one entity or action from another entity or action, without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

Figure 2:
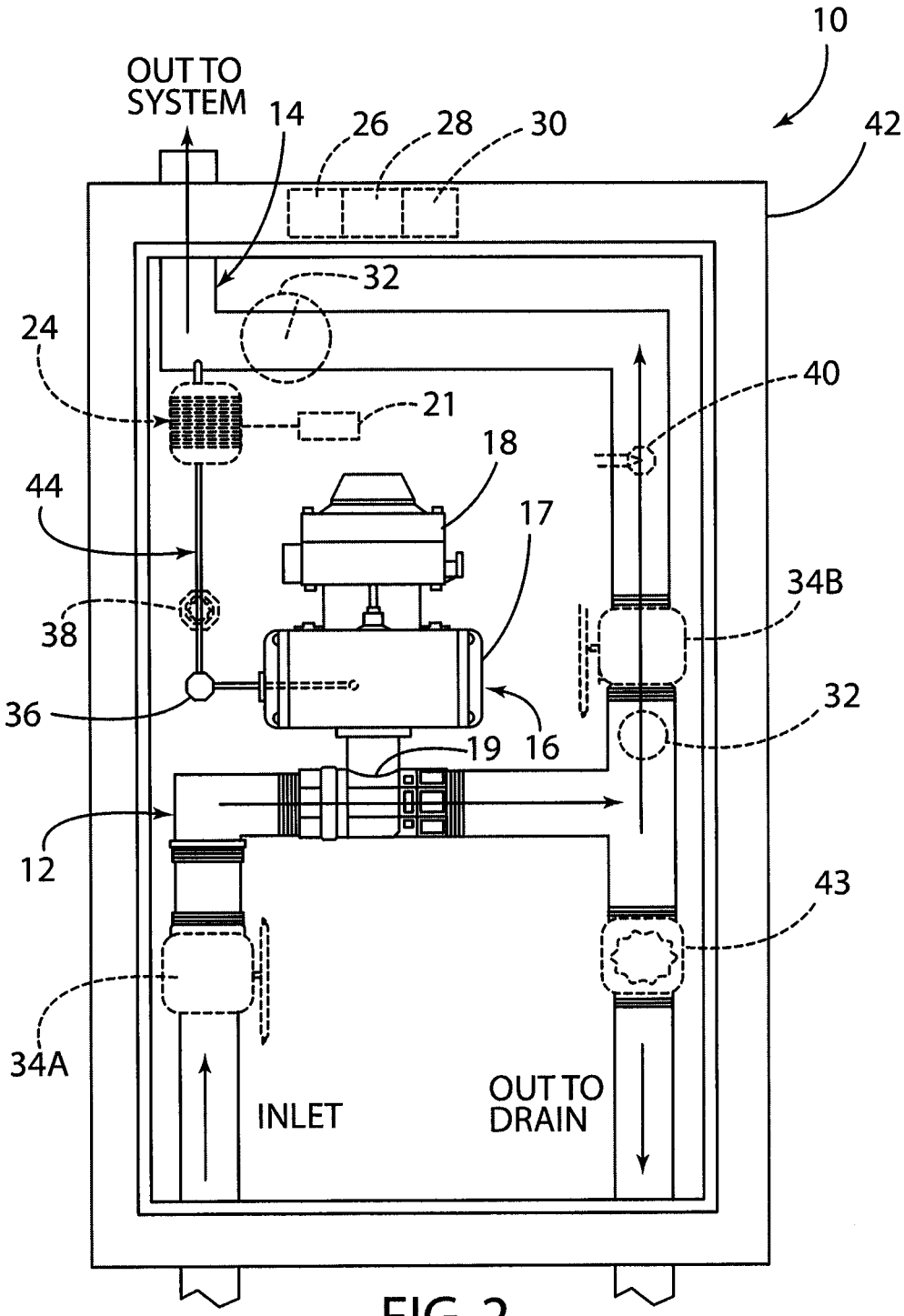
FIG. 2 is a schematic plan view of a fire suppression system, in accordance with one embodiment of the present invention.

In reference to FIGS. 1 and 2, a fire suppression system is generally shown at reference identifier 10. The fire suppression system 10 (FIGS. 1-2) has at least one inlet pipe generally indicated at 12 and at least one outlet pipe generally indicated at 14. The inlet pipe 12 and outlet pipe 14 are in fluid communication with one another, and a valve assembly, generally indicated at 16, is in fluid communication between the inlet pipe 12 and outlet pipe 14. Thus, the fluid communication among components generally allows a fluid substance to flow through components, to components from other components that are directly or indirectly connected, or a combination thereof. A fluid substance in the inlet pipe 12 creates a first pressure in the inlet pipe 12, and a gaseous fluid contained in the outlet pipe 14 creates a second pressure in the outlet pipe 14. The fire suppression system 10 can be a pneumatic fire suppression system or a vacuum fire suppression system due to the gaseous fluid contained in the outlet pipe 14, wherein the valve assembly 16 is actuated based upon an alteration of the second pressure, as described in greater detail herein.

According to one embodiment, the inlet pipe 12 is connected to one portion of the valve assembly 16, and is filled with the fluid substance that is used to extinguish a fire, such as, but not limited to water. Thus, the fluid substance creates the first pressure in the inlet pipe 12. The outlet pipe 14 is connected to another portion of the valve assembly 16 and is filled, such that the outlet pipe 14 is precharged, with a gaseous fluid, such as, but not limited to, compressed air, according to one embodiment. Thus, the compressed air contained in the outlet pipe 14 creates the second pressure when the fire suppression system 10 is a pneumatic system. According to an alternate embodiment, the outlet pipe 14 contains the gaseous fluid, such that at least a portion of the gaseous fluid is removed from said outlet pipe 14 to substantially create a vacuum, which creates the second pressure in the outlet pipe 14 when the fire suppression system 10 is a vacuum system.

The fire suppression system 10 is a dry pipe fire suppression system, according to one embodiment. The inlet pipe 12 can be referred to as the wet or active side and the outlet pipe 14 can be referred to as the dry or passive side. Generally, the wet side can be referred to as the active side because this side of the fire suppression system 10 is generally at least partially filled with the fluid substance when the fire suppression system 10 is functioning, and the valve assembly 16 is closed. The dry side can be referred to as the passive side because this side is properly charged with compressed air or is substantially a vacuum and reacts to other components of the fire suppression system 10, as described in greater detail below.

By way of explanation and not limitation, the valve assembly 16 is an air-to-close valve and is designed to use the second pressure from the outlet pipe 14 to remain in a closed position so that the fluid from the inlet pipe 12 does not enter the outlet pipe 14 at undesirable times. Thus, the valve assembly 16 can be an actuated valve assembly, such as a direct-acting actuated dry valve assembly, according to one embodiment.

The valve assembly 16 can include an actuator 17 and a limit switch 18, wherein the actuator 17 is actuated to open and close a valve 19 based upon the second pressure, according to one embodiment. For purposes of explanation and not limitation, the valve 19 can be, but is not limited to, a ball valve, a butterfly valve, or the like. When the valve 19 is in a fully closed position, the valve 19 is located to at least substantially block the flow of the fluid substance from the inlet pipe 12 to the outlet pipe 14, and when the valve 19 is in an open position, the valve 19 is positioned to allow flow of the fluid substance between the inlet pipe 12 and the outlet pipe 14. Typically, the limit switch 18 is in operable communication with the valve 19, such that when the valve 19 actuates, the limit switch 18 rotates, and a user can determine the location of the valve 19 by the rotational location of the limit switch 18. According to one embodiment, the valve assembly 16 includes a VALTORC™ actuator, a VALTORC™ limit switch, and a VALTORC™ ball valve.

According to one embodiment, the outlet pipe 14 has a single connection with the valve assembly 16, and has at least one branch 20 that extends from the outlet pipe 14. Typically, the outlet pipe 14, the branch 20, or a combination thereof, define at least one opening, wherein the gaseous fluid enters or exits the outlet pipe 14 through the at least one opening to alter the second pressure. The fluid substance then exits the outlet pipe 14 through the at least one opening. According to one embodiment, the opening is at least one sprinkler head 22 that is connected to an end of the branch 20. Generally, the sprinkler head 22 is altered to form the opening, as described in greater detail below. It should be appreciated by those skilled in the art that that the sprinkler head 22 can be connected to other portions of the branch 20, the outlet pipe 14, or a combination thereof. Additionally or alternatively, the outlet pipe 14 can be a leak free pipe, such as, but not limited to, welded piping, such as Fusiotherm piping, metallic piping, such as copper piping, solder piping, or brazed piping, or non-metallic piping, such as polyvinyl chloride (PVC), the like, or a combination thereof, according to one embodiment.

An alarm system, generally indicated at 24, can be operably connected to the inlet pipe 12, the outlet pipe 14, valve assembly 16, or a combination thereof, according to one embodiment. The alarm 24 can have three settings, wherein the first setting 26 can be a green light, which indicates that the fire suppression system 10 is operating under normal conditions. The second setting 28 can be a yellow light, which indicates that the first pressure in the inlet pipe 12, the second pressure in the outlet pipe 14, or a combination thereof is below a predetermined level. The third setting 30 can be a red light that indicates there is flow or activation in the fire suppression system 10, such as the fluid substance of the inlet pipe 12 has entered the outlet pipe 14, a pressure loss less than that required to maintain closer of valve 19, or a combination thereof. It should be appreciated by those skilled in the art that the alarm system 24 can have additional or less settings depending on how many pressure levels it is desirable to monitor. Additionally, the fire suppression system 10 can include a battery 21 that is electrically connected to one or more components of the fire suppression system 10, such as, but not limited to, an alarm 24, according to one embodiment.

According to one embodiment, a pressure sensor or gauge 32 can be placed on the outlet pipe 14. The pressure gauge 32 is used to determine the pressure in the outlet pipe 14 at any given time. One exemplary pressure gauge 32 is an Ashcroft pressure gauge. However, it should be appreciated by those skilled in the art that the pressure gauge 32 can be an electronic pressure sensor or other types of suitable pressure gauges. Additionally or alternatively, at least one control valve is in operable communication with the inlet pipe 12 and the outlet pipe 14, so that portions of the inlet pipe 12 or outlet pipe 14 can be separated from one another. According to one embodiment, a first control valve 34A is in operable communication with the inlet pipe 12, and a second control valve 34B is in operable communication with the outlet pipe 14.

A valve 36 is in operable communication with the outlet pipe 14 and the valve assembly 16. According to one embodiment, charged air is entered into the outlet pipe 14 through the valve 36 in order to increase the air pressure of the outlet pipe 14. According to an alternate embodiment, the valve 36 is used to remove air from the outlet pipe 14 to create a vacuum. For purposes of explanation and not limitation, the valve 36 can be a Schraeder valve. Additionally or alternatively, a tee 38 and a transducer 40 can be in operable communication in the outlet pipe 14. The transducer 40 can be a two-point or eight-point transducer to monitor the second pressure of the outlet pipe 14, according to one embodiment. Additionally, the transducer 40 can be operably connected to a dialer, or other communication device, so that a signal can be transmitted to a third party when either or both of the first and second pressures are at predetermined pressure levels, the valve assembly 16 is open and the fluid substance is entering the outlet pipe 14, the like, or a combination thereof, according to one embodiment. The dialer can communicate through, but not limited to, telephone lines, data lines, wireless communication, or the like.

Further, a portion of the inlet pipe 12, a portion of the outlet pipe 14, and the valve assembly 16 can be enclosed within a housing 42, such that the housing 42 has three openings for the inlet pipe 12, the outlet pipe 14 going to the branches 20, and the outlet pipe 14 going to a drain, according to one embodiment. Thus, the portion of the fire suppression system 10 that is within the housing 42 can be considered a single unit, wherein the unit can be connected in the fire suppression system 10 by the three piping connections, according to one embodiment.

In reference to FIG. 2, the control valve 34A is in fluid communication with the inlet pipe 12, the control valve 34B is in fluid communication with the portion of the outlet pipe 14 that directs flow to the branches 20, and a gate valve 43 is in fluid communication with the portion of the outlet pipe 14 that directs flow to the drain. Additionally, the pressure gauge 32 and transducer 40 are on opposite sides of the control valve 34B, and a second pressure gauge 32 can be downstream of the transducer 40, according to one embodiment.

According to one embodiment, a feedback generally indicated at 44 feeds a portion of the gaseous fluid from the outlet pipe 14 back to the valve assembly 16. According to one embodiment, the alarm 24, tee 38, and valve 36 are in fluid communication with the feedback 44. Typically, the feedback 44 provides a pressure, such as the second pressure, to the valve assembly 16, so that the valve assembly 16 can actuate as a function of the provided pressure. Thus, the feedback 44 can connect the actuator 17 and the outlet pipe 14, so that the actuator 17 and outlet pipe 14 are in fluid communication, and the actuator 17 actuates as a function of the provided pressure, according to one embodiment. Additionally or alternatively, a pressure regulating valve, a pressure reducing valve, or a combination thereof can be in operable communication with feedback 44 to control the second pressure in the outlet pipe 14, the pressure provided to the valve assembly 16, or a combination thereof.

Figure 3:
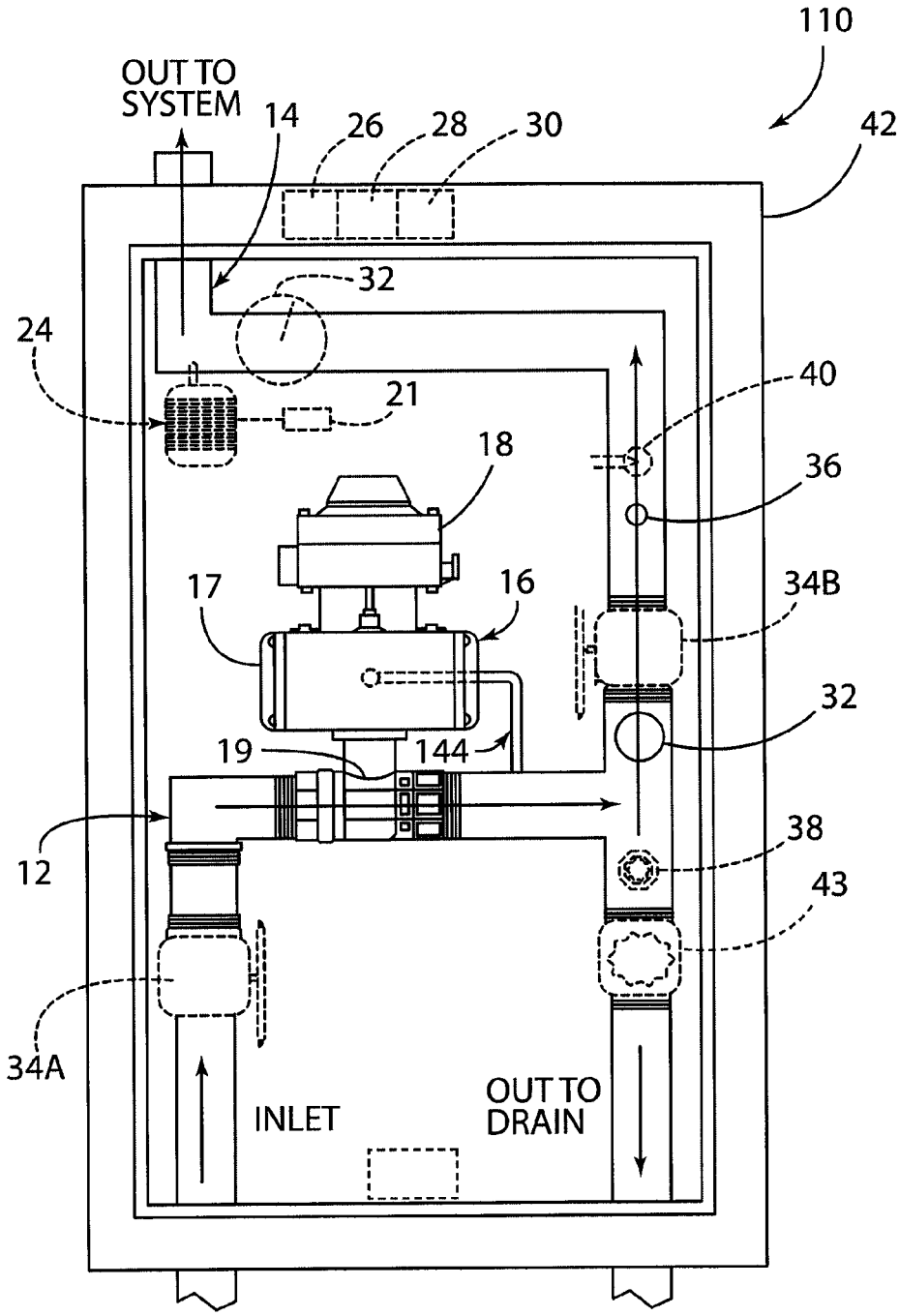
FIG. 3 is a schematic plan view of a fire suppression system, in accordance with an alternate embodiment of the present invention.

According to an embodiment shown in FIG. 3, a fire suppression system is generally shown at reference identifier 110. The fire suppression system 110 includes the inlet pipe 12, the outlet pipe 14, and the valve assembly 16. Additionally, the fire suppression system 110 can include the alarm system 24, the pressure gauge 32, the inlet control valve 34A, the outlet control valve 34B, the valve 36, the tee 38, the transducer 40, the housing 42, the gate valve 43, or a combination thereof, according to one embodiment. Further, the fire suppression system 110 includes a feedback 144 that connects a portion of the outlet pipe 14 to the actuator 17, such that a pressure is provided to the actuator 17 from the outlet pipe 14, according to one embodiment. Thus, the actuator 17 can actuate as a function of the provided pressure.

Figure 4:
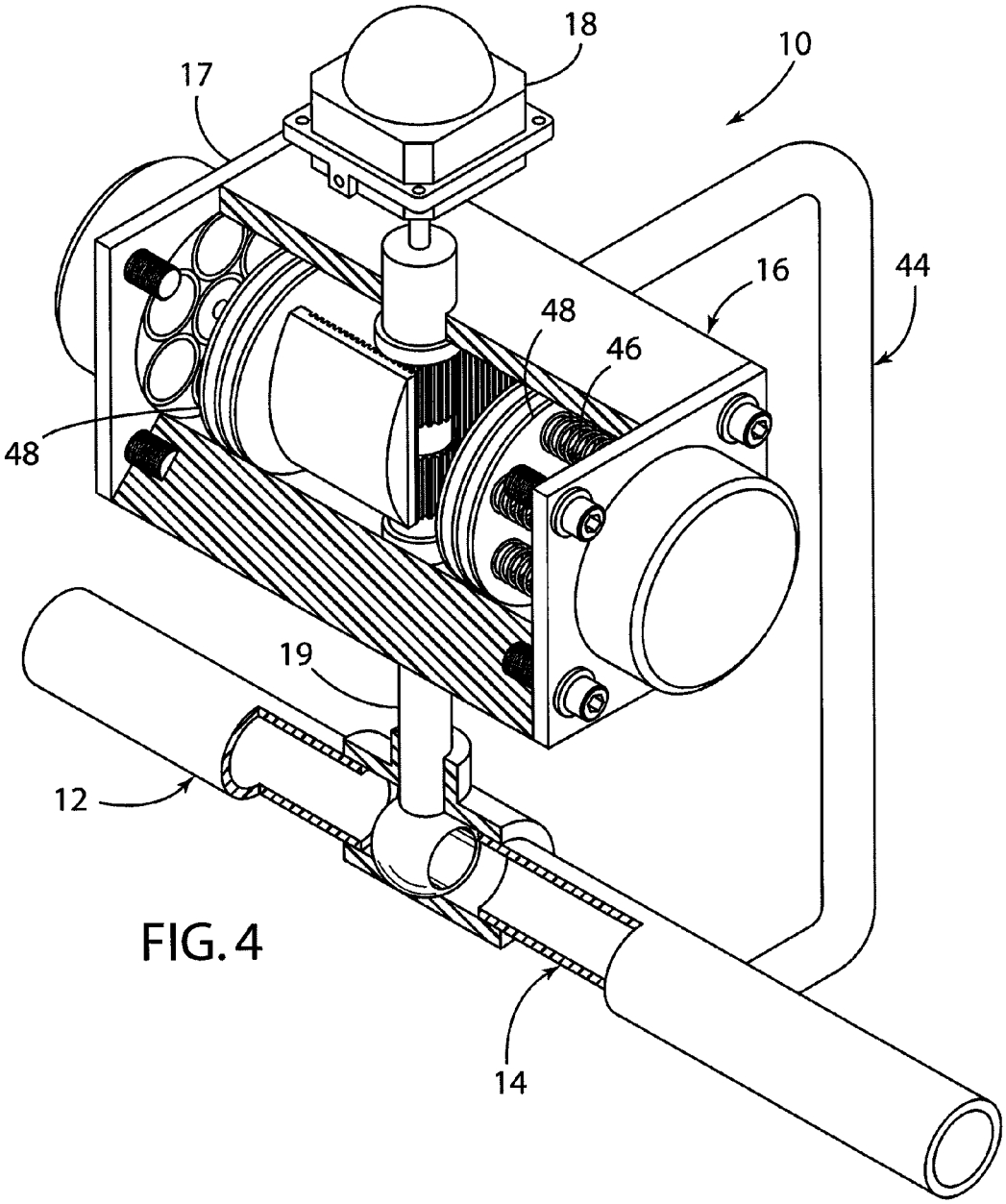
FIG. 4 is a perspective cross-sectional view of a valve assembly in a fire suppression system, in accordance with one embodiment of the present invention.

In reference to FIG. 4, the actuator 17 includes at least one spring 46 having a tension and at least one piston 48 biased by the at least one spring 46. According to one embodiment, when the fire suppression system 10,110 is a pneumatic fire suppression system, such that the pressurized gaseous fluid is contained in the outlet pipe 14, the gaseous fluid pressure fed back to the actuator 17 from the outlet pipe 14 through the feedback 44,144 is adequate to overcome the tension of the spring 46 in order to bias the piston 48 in a closed position. Thus, when the pressure of the gaseous fluid in the outlet pipe 14 (i.e., the second pressure) is below a predetermined level, the second pressure is inadequate to overcome the tension of the spring 46, and the spring 46 biases the piston 48 in an open position, according to one embodiment. Thus, piston 48 "fails open" when the second pressure is at or below a predetermined value, such that the gaseous fluid exits the outlet pipe 14 and the fluid substance passes through the valve assembly 16 into the outlet pipe 14 and exits the outlet pipe 14.

When the fire suppression system 10,110 is a vacuum system, the outlet pipe 14 contains a gaseous fluid in order to create a vacuum, and the pressure created in the outlet pipe 14 is fed back to the actuator 17 through the feedback 44,144, such that the pressure is inadequate to overcome the spring 46 tension, so that the spring 46 biases the piston 48 in a closed position. As an opening is formed in the outlet pipe 14, and the gaseous fluid enters the outlet pipe 14, which increases the second pressure, the pressure supplied from the outlet pipe 14 to the actuator 17 through the feedback 44,144 is adequate to overcome the spring 46 tension and the spring 46 biases the piston 48 in an open position. Thus, the valve 19 opens in order to allow the fluid substance from the inlet pipe 12 to flow through the valve assembly 16 and into the outlet pipe 14, and the fluid substance exits the outlet pipe 14 through the opening.

Figure 5:
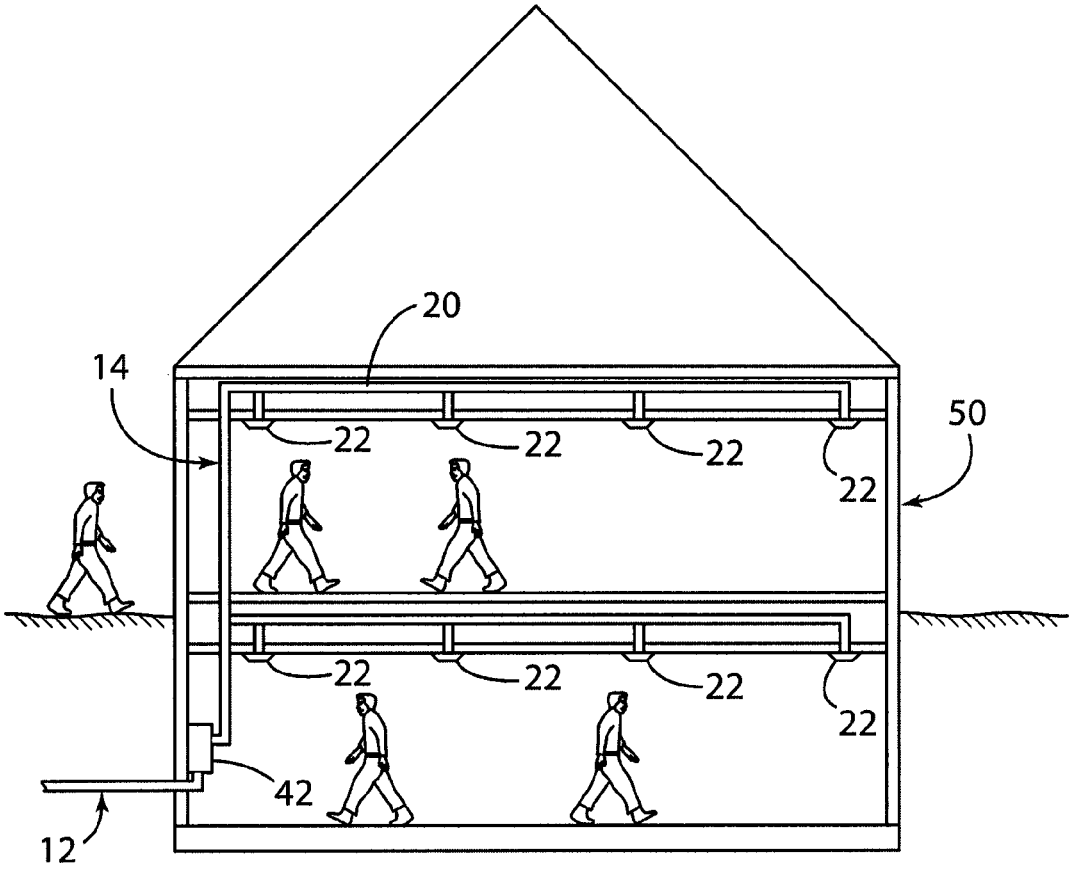
FIG. 5 is an environmental view of a fire suppression system, in accordance with one embodiment of the present invention.

For purposes of explanation and not limitation, in reference to FIGS. 1-5 and in operation, the fire suppression system 10,110 is used in a dwelling generally indicated at 50 in FIG. 5. The dwelling 50 can be, but is not limited to, a domestic or residential dwelling. The inlet pipe 12 enters the dwelling 50, and is filled with the fluid substance, such as water, from the domestic water line. The valve assembly 16 then connects and separates the inlet pipe 12 and outlet pipe 14. Typically, the valve assembly 16 is connected to the inlet pipe 12 relatively close to the point of entrance of the inlet pipe 12 into the dwelling 50; thus, limiting the amount of pipes 12, 14, 20 filled with the fluid substance that extend throughout the dwelling 50. The outlet pipe 14 and branches 20 extend throughout the dwelling 50. However, it should be appreciated by those skilled in the art that the valve assembly 16 can be placed any where in the dry pipe fire suppression system 10, such that the dry or passive portion of the system 10 is only a specific zone(s), or as an extension of an existing wet pipe fire suppression system. It should further be appreciated by those skilled in the art that the fire suppression system 10 can be used in other dwellings, such as, but not limited to, industrial dwellings and commercial dwellings.

Typically, the first pressure created by the fluid in the inlet pipe 12 is about 80 psi (pounds per square inch), according to one embodiment. However, it should be appreciated by those skilled in the art that the first pressure can be any pressure level, and can be dependent upon the fluid substance system that provides the fluid substance to the inlet pipe 14. When the fire suppression system 10,110 is a pneumatic fire suppression system, the outlet pipe 14 is filled with compressed air, which creates the second pressure of about 20 psi, according to one embodiment, wherein the outlet pipe 14 is a metallic material. According to an alternate embodiment, the second pressure is about 15 psi, when the outlet pipe 14 is made of a non-metallic material, and the fire suppression system 10,110 is a pneumatic fire suppression system. The second pressure in the outlet pipe 14 can be any predetermined pressure, but it should be appreciated by those skilled in the art that the second pressure is adequate to make the actuator 17 actuate as a function of the second pressure. According to one embodiment, the actuator 17 can be actuated when the pressure in the outlet pipe 14 is altered from a set point by less than sixty percent (60%), and more specifically, when the pressure in the outlet pipe 14 is altered by less than thirty percent (30%).

By way of explanation and not limitation, the sprinkler heads 22 are any type of suitable sprinkler head 22. According to one embodiment, the sprinkler head 22 has a melting seal, and thus, as the heat around the sprinkler head 22 increases the melting seal of the sprinkler head 22 melts which opens the sprinkler head 22 and allows the gaseous fluid to enter or exit the outlet pipe 14 and branches 20, depending upon whether the fire suppression system 10 is a pneumatic or vacuum system. The melting seal may not completely disintegrate, but will at least partially melt, reshape, reduce in size, the like, or a combination thereof, in order to form an opening in the sprinkler head 22. When the gaseous fluid enters or exits the outlet pipe 14, the second pressure is altered to a pressure level that causes the valve assembly 16 to actuate and open. Thus, the valve 19 opens when the second pressure is no longer adequate to overcome the spring 46 tension of the actuator 17 when the fire suppression system 10,110 is a pneumatic system, such that the valve 19 then opens, according to one embodiment. According to an alternate embodiment, when the fire suppression system 10,110 is a vacuum system, the valve 19 opens when the second pressure is adequate to overcome the spring 46 tension of the actuator 17. Thus, the valve 19 can be a mechanically actuated ball valve that "fails open" (i.e., pneumatic system or vacuum system). The fluid is then dispensed from the sprinkler heads 22 onto the fire or heat source that melted the seal of the sprinkler heads 22.

For purposes of explanation and not limitation, the inlet pipe 12 enters the dwelling 50, and immediately connects to the valve assembly 16 and outlet pipe 14, according to one embodiment. Therefore, the vast majority of the fire suppression system 10,110 in the dwelling comprises the outlet pipe 14, which is dry, since it does not contain any fluid substance unless the fluid substance is being discharged through the sprinkler heads 22. Alternatively, the valve assembly 16 is located in a different location in the fire suppression system 10 so that only a portion of zone(s) of the system 10,110 are dry.

Figure 6:
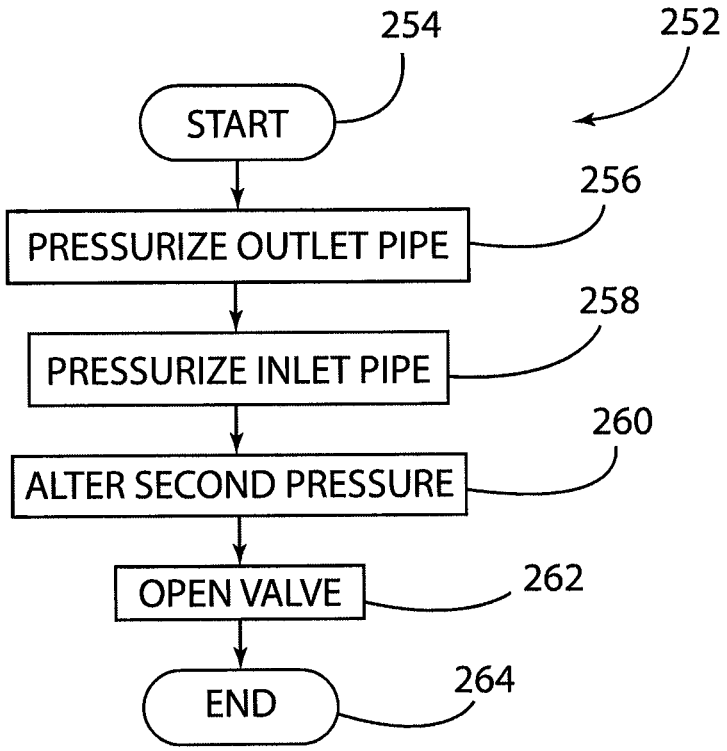
FIG. 6 is a flow chart illustrating a method of suppressing a fire, in accordance with one embodiment of the present invention.

With regards to FIG. 6, a method of suppressing a fire is generally shown at reference identifier 252. The method 252 starts at step 254, and proceeds to step 256, wherein the outlet pipe 14 is pressurized. At step 258, the inlet pipe 12 is pressurized. Typically, the inlet pipe 12 is pressurized to the first pressure, wherein a fluid substance is in the inlet pipe 12 and creates the first pressure, according to one embodiment. According to one embodiment, the fire suppression system 10,110 is a pneumatic system, and the outlet pipe 14 is filled with the gaseous fluid, such as, but not limited to, compressed air, to obtain the second pressure. According to an alternate embodiment, the fire suppression system 10,110 is a vacuum system, and the gaseous fluid contained within the outlet pipe 14 substantially creates a vacuum to obtain the second pressure.

The method 252 then proceeds to step 260, wherein the second pressure is altered. According to one embodiment, the second pressure is altered by the outlet pipe 14, the branches 20, or a combination thereof, defining the opening, which allows the gaseous fluid to enter or exit the outlet pipe 14 to alter the second pressure. According to one embodiment, the sprinkler head 22 defines the opening. At step 262, the valve assembly 16 is open. According to one embodiment, wherein the fire suppression system 10,110 is a pneumatic system, the gaseous fluid exits the outlet pipe 14, such that the second pressure is no longer adequate to overcome the spring 46 tension to bias the piston 48 in a closed position, and the valve 19 is opened. According to an alternate embodiment, wherein the fire suppression system 10,110 is a vacuum system, the gaseous fluid enters the outlet pipe 14, and the second pressure is adequate to overcome the spring 46 tension and bias the piston 48 to open the valve 19. The method 252 then ends at step 264.

Advantageously, the fire suppression system 10,110 and method 252 thereof is a dry valve system so that a portion of the system 10,110 does not contain a fluid substance when under normal operating conditions and the valve assembly 16 is in a fully closed position. Thus, the fire suppression system 10,110 can be used in uncontrolled climates where freezing temperatures, extreme heat temperatures, and extreme temperature fluctuations are reached. Additionally, when the fire suppression system 10,110 is actuated, such that the valve assembly 16 is to be opened, the actuator 17 can be actuated to open the valve assembly 16 quickly, since the actuator 17 can be actuated with a less than sixty percent (60%) change in the pressure in the outlet pipe 14. It should be appreciated by those skilled in the art that there can be other advantages of the fire suppression system 10,110 and method thereof.

The above description is considered that of preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

What is claimed is:

1. A fire suppression system comprising:

at least one inlet pipe at least partially filled with a fluid substance, wherein said fluid substance creates a first pressure in said at least one inlet pipe;

at least one outlet pipe in fluid communication with said at least one inlet pipe and contains a gaseous fluid, wherein said gaseous fluid creates a second pressure in said at least one outlet pipe;

a feedback in fluid communication with said at least one outlet pipe; and a valve assembly in fluid communication between said at least one inlet pipe and said at least one outlet pipe, and in fluid communication with said feedback, wherein said fluid substance enters said at least one outlet pipe through said valve assembly when said second pressure is altered to a predetermined pressure, said valve assembly comprising:

a valve; and an actuator operably connected to said valve, said actuator comprising:

at least one spring having a tension; and at least one piston biased by said at least one spring, wherein when said second pressure is applied to said valve assembly from said at least one outlet pipe through said feedback and is adequate to overcome said tension of said at least one spring, said at least one piston is in a closed position, such that said valve is in a closed position, and when said second pressure is not adequate to overcome said tension of said at least one spring, said at least one piston is in an open position, such that said valve is in an open position;

wherein the fire suppression system is one of a pneumatic actuated dry valve fire suppression system and a vacuum actuated dry valve fire suppression system.

2. The fire suppression system of claim 1, wherein said valve assembly is a direct-acting actuated dry valve.

3. The fire suppression system of claim 1, wherein said valve assembly actuates, such that said fluid substance flows from said inlet pipe to said outlet pipe when said second pressure is altered by less than sixty percent (60%).

4. The fire suppression system of claim 1 further comprising an alarm, wherein said alarm is activated when at least one of said first pressure and said second pressure is at a predetermined pressure.

5. The fire suppression system of claim 1, wherein said operable connection of said valve and said actuator is a rack and pinion connection, such that a change in said second pressure that is inadequate to overcome said tension of said at least one spring biases said at least one piston to actuate said rack and pinion connection so said valve is actuated into said open position.

6. A fire suppression system comprising:

at least one inlet pipe at least partially filled with a fluid substance, wherein said fluid creates a first pressure in said at least one inlet pipe;

at least one outlet pipe in fluid communication with said at least one inlet pipe and contains a gaseous fluid, wherein said gaseous fluid creates a second pressure in said at least one outlet pipe, and said at least one outlet pipe defines at least one opening;

a feedback in fluid communication with said at least one outlet pipe; and a direct-acting actuated dry valve assembly in fluid communication between said at least one inlet pipe and said at least one outlet pipe, said direct-acting actuated dry valve assembly comprises:

a valve; and an actuator operably connected to said valve, said actuator comprising:

at least one spring having a tension; and at least one piston biased by said at least one spring, wherein when said second pressure is applied to said valve assembly from said at least one outlet pipe through said feedback and is adequate to overcome said tension of said at least one spring, said at least one piston is in a closed position, such that said valve is in a closed position, and when said second pressure is not adequate to overcome said tension of said at least one spring, said at least one piston is in an open position, such that said valve is in an open position;

wherein said fluid substance enters said at least one outlet pipe through said direct-acting actuated valve assembly when said second pressure is altered to a predetermined pressure, and said fluid substance exits said at least one outlet pipe through said at least one opening;

wherein said at least one opening is an at least one sprinkler head, such that said gaseous fluid one of exits and enters said at least one outlet pipe through said at least one sprinkler head to alter said second pressure.

7. The fire suppression system of claim 6 further comprising an alarm, wherein said alarm is activated when said second pressure is at a predetermined pressure.

8. The fire suppression system of 6, wherein said valve is a mechanically actuated ball valve.

9. The fire suppression system of claim 6, wherein said operable connection of said valve and said actuator is a rack and pinion connection, such that a change in said second pressure that is inadequate to overcome said tension of said at least one spring biases said at least one piston to actuate said rack and pinion connection so said valve is actuated into said open position.

10. A method of suppressing a fire, said method comprising the steps of:

pressurizing an inlet pipe at a first pressure with a fluid substance;

pressurizing an outlet pipe at a second pressure with a gaseous substance;

applying said second pressure to a valve assembly that is in fluid communication between said inlet and outlet pipes through a feedback from said outlet pipe;

biasing at least one spring to close at least one piston based upon said second pressure feedback to said valve assembly to close a valve between said inlet pipe and said outlet pipe;

altering said second pressure in said outlet pipe; and opening said valve assembly when said second pressure is altered, wherein said alteration of second pressure is not adequate to bias said at least one spring to close said at least one piston, such that said valve opens, and said gaseous fluid one of enters and exits said outlet pipe to alter said second pressure and said fluid substance enters and exits said outlet pipe.

11. The method of claim 10, wherein said at least one outlet pipe defines at least one opening, and said gaseous fluid one of enters and exits through said at least one opening to alter said second pressure and said fluid substance enters said at least one outlet pipe through said valve and said fluid substance exits said at least one outlet pipe through said at least one opening.

12. The method of claim 10 further comprising the step of activating an alarm when at least one of said inlet pipe and outlet pipe pressures is at a predetermined level.

13. The method of claim 10, wherein a fire suppression system is one of a pneumatic dry valve fire suppression system and a vacuum dry valve fire suppression system.

14. The method of claim 10, wherein said step of opening said valve assembly comprises said operable connection of said valve and said actuator being a rack and pinion connection, such that a change in said second pressure that is inadequate to overcome said tension of said at least one spring biases said at least one piston to actuate said rack and pinion connection so said valve is actuated into said open position.

15. A fire suppression system comprising:

at least one inlet pipe at least partially filled with a fluid substance, wherein said fluid substance creates a first pressure in said at least one inlet pipe;

at least one outlet pipe in fluid communication with said at least one inlet pipe and contains a gaseous fluid, wherein said gaseous fluid creates a second pressure in said at least one outlet pipe;

a feedback in fluid communication with said at least one outlet pipe; and a valve assembly in fluid communication between said at least one inlet pipe and said at least one outlet pipe and in fluid communication with said feedback, wherein said fluid substance enters said at least one outlet pipe through said valve assembly when said second pressure is altered to a predetermined pressure, said valve assembly comprising:

a valve; and an actuator operably connected to said valve, said actuator comprising:

at least one spring having a tension; and at least one piston biased by said at least one spring, wherein when said second pressure is applied to said valve assembly from said at least one outlet pipe through said feedback and is adequate to overcome said tension of said at least one spring, said at least one piston is in a closed position, such that said valve is in a closed position, and when said second pressure is not adequate to overcome said tension of said at least one spring, said at least one piston is in an open position, such that said valve is in an open position;

wherein said at least one outlet pipe defines at least one opening, and said gaseous fluid one of enters and exits through said at least one opening to alter said second pressure and said fluid substance enters said at least one outlet pipe through said valve assembly and said fluid substance exits said at least one outlet pipe through said at least one opening.

16. The fire suppression system of claim 15, wherein said operable connection of said valve and said actuator is a rack and pinion connection, such that a change in said second pressure that is inadequate to overcome said tension of said at least one spring biases said at least one piston to actuate said rack and pinion connection so said valve is actuated into said open position.

17. A fire suppression system comprising:

at least one inlet pipe at least partially filled with a fluid substance, wherein said fluid substance creates a first pressure in said at least one inlet pipe;

at least one outlet pipe in fluid communication with said at least one inlet pipe and contains a gaseous fluid, wherein said gaseous fluid creates a second pressure in said at least one outlet pipe;

a feedback in fluid communication with said at least one outlet pipe;

a valve assembly in fluid communication between said at least one inlet pipe and said at least one outlet pipe, wherein said fluid substance enters said at least one outlet pipe through said valve assembly when said second pressure is altered to a predetermined pressure, said valve assembly comprising:

a valve; and an actuator operably connected to said valve, said actuator comprising:

at least one spring having a tension; and at least one piston biased by said at least one spring, wherein when said second pressure is applied to said valve assembly from said at least one outlet pipe through said feedback and is adequate to overcome said tension of said at least one spring, said at least one piston is in a closed position, such that said valve is in a closed position, and when said second pressure is not adequate to overcome said tension of said at least one spring, said at least one piston is in an open position, such that said valve is in an open position; and at least one sprinkler head in fluid communication with said at least one outlet pipe, wherein said gaseous fluid one of exits and enters said at least one outlet pipe through said at least one sprinkler head to alter said second pressure, and said fluid substance enters said outlet pipe through said valve and exits said outlet pipe through said sprinkler head.

18. The fire suppression system of claim 17, wherein said operable connection of said valve and said actuator is a rack and pinion connection, such that a change in said second pressure that is inadequate to overcome said tension of said at least one spring biases said at least one piston to actuate said rack and pinion connection so said valve is actuated into said open position.

19. A fire suppression system comprising:

at least one inlet pipe at least partially filled with a fluid substance, wherein said fluid substance creates a first pressure in said at least one inlet pipe;

at least one outlet pipe in fluid communication with said at least one inlet pipe and contains a gaseous fluid, wherein said gaseous fluid creates a second pressure in said at least one outlet pipe;

a feedback in fluid communication with said at least one outlet pipe; and a valve assembly in fluid communication between said at least one inlet pipe and said at least one outlet pipe, and in fluid communication with said feedback, wherein said fluid substance enters said at least one outlet pipe through said valve assembly when said second pressure is altered to a predetermined pressure, wherein said valve assembly comprises:

a valve; and an actuator operably connected to said valve, said actuator comprising:

at least one spring having a tension; and at least one piston that is biased towards an open position by said spring tension, wherein when said valve is in a closed position, said second pressure feedback to said actuator from said outlet pipe through said feedback is adequate to overcome said spring tension so said at least one piston is in a closed position, and when said valve assembly is in an open position, said second pressure is inadequate to overcome said spring tension so said at least one piston is in said open position.

20. The fire suppression system of claim 19, wherein said operable connection of said valve and said actuator is a rack and pinion connection, such that a change in said second pressure that is inadequate to overcome said tension of said at least one spring biases said at least one piston to actuate said rack and pinion connection so said valve is actuated into said open position.

21. A fire suppression system comprising:

at least one inlet pipe at least partially filled with a fluid substance, wherein said fluid creates a first pressure in said at least one inlet pipe;

at least one outlet pipe in fluid communication with said at least one inlet pipe and contains a gaseous fluid, wherein said gaseous fluid creates a second pressure in said at least one outlet pipe, and said at least one outlet pipe defines at least one opening;

a feedback in fluid communication with said at least one outlet pipe; and a direct-acting actuated dry valve assembly in fluid communication between said at least one inlet pipe and said at least one outlet pipe, and in fluid communication with said feedback, wherein said fluid substance enters said at least one outlet pipe through said direct-acting actuated valve assembly when said second pressure is altered to a predetermined pressure, and said fluid substance exits said at least one outlet pipe through said at least one opening, wherein said valve assembly comprises:

a valve; and an actuator operably connected to said valve, said actuator comprising:

at least one spring having a tension; and at least one piston that is biased by said at least one spring towards an open position by said spring tension, wherein when said valve is in a closed position, said second pressure feedback to said actuator from said outlet pipe through said feedback is adequate to overcome said spring tension so said at least one piston is in a closed position and when said valve assembly is in an open position, said second pressure is inadequate to overcome said spring tension so said at least one piston is in said open position.

22. The fire suppression system of claim 21, wherein said operable connection of said valve and said actuator is a rack and pinion connection, such that a change in said second pressure that is inadequate to overcome said tension of said at least one spring biases said at least one piston to actuate said rack and pinion connection so said valve is actuated into said open position.

* * * * *